United States Patent [19]

Otto et al.

[11] 3,995,792

[45] Dec. 7, 1976

[54] LASER MISSILE GUIDANCE SYSTEM

[75] Inventors: William F. Otto; William B. McKnight; James J. Fagan, all of Huntsville, Ala.

[73] Assignee: The United States of America as represented by the Secretary of the Army, Washington, D.C.

[22] Filed: Oct. 15, 1974

[21] Appl. No.: 514,697

[52] U.S. Cl. ..... 244/3.14; 250/203 R

[51] Int. Cl.[2] ..... F41G 7/14; F41G 7/18; F41G 9/00

[58] Field of Search ..... 244/3.13, 3.14, 3.16; 250/203

[56] References Cited

UNITED STATES PATENTS

| | | | |
|---|---|---|---|
| 3,374,967 | 3/1968 | Plumley | 244/3.14 |
| 3,603,686 | 9/1971 | Paine | 250/203 |
| 3,698,811 | 10/1972 | Weil | 244/3.14 |
| 3,848,830 | 11/1974 | Born | 244/3.16 |
| 3,899,145 | 8/1975 | Stephenson | 244/3.13 |

*Primary Examiner*—Samuel W. Engle
*Assistant Examiner*—Thomas H. Webb
*Attorney, Agent, or Firm*—Nathan Edelberg; Robert P. Gibson; James T. Deaton

[57] ABSTRACT

A laser missile guidance system in which a projectile or missile is fired toward a predetermined target with the missile being tracked on its flight toward the target by laser radar, processing the laser radar information in a computer apparatus and finally computing a new trajectory from the missile to the target and transmitting correction signals to a correction device on the missile including thrusters on the missile to cause the trajectory of the missile to be changed to the newly computed trajectory for the missile. This system corrects the trajectory of the missile while in flight by recomputing a trajectory from the missile to the predetermined target and making appropriate corrections each time. This enables the missile to only contain laser radar reflecting means, and correction detection and control means on the missile rather than having gyro and laser type devices on board the missile which take up a considerable amount of space and weight.

3 Claims, 4 Drawing Figures

LASER MISSILE GUIDANCE SYSTEM

BACKGROUND OF THE INVENTION

Weapon systems in the past have generally had projectiles with no appreciable means for correcting the trajectory of the projectile or missile after being fired or they have included elaborate mechanisms such as radar detectors and sophisticated gyro guidance means that have taken up considerable weight and space on board the projectile or missile.

Therefore, it is an object of this invention to provide a low cost per round projectile or missile that has no internal gyros or costly controls therein.

Another object of this invention is to provide a projectile or missile that has high velocity and can perform as conventional artillery.

A further object of this invention is to provide a system which retains the effectiveness of normal artillery even with complete failure of the laser radar.

Still another object of this invention is to provide a system that can utilize conventional rounds in the gun type launcher with laser radar giving target range.

A still further object of this invention is to provide a system in which the missile or projectile has low spin rates and high accuracy which permit the use of shape charge warheads that have the capability of defeating hard targets.

SUMMARY OF THE INVENTION

In accordance with this invention, a laser missile guidance system is provided which includes a predetermined target area with a missile or projectile launcher mounted in a predetermined relationship thereto, a missile or projectile with laser reflecting and detecting means thereon, a laser tracker for sending and receiving signals from the laser reflector on the missle and a command computer interconnected with the tracker and detector for computing the measured projectile position and velocity and producing error corrections therefrom in the form of a new trajectory from said missile to said target. This is accomplished by sending correction coded laser radar signals by the laser tracker to the correction device on board the missile or projectile. The correction device has thrusters which correct the missile or projectile to cause it to be directed in the newly computed trajectory from the missile or projectile to the target.

DESCRIPTION OF THE PREFERRED EMBODIMENT

Figure 1:
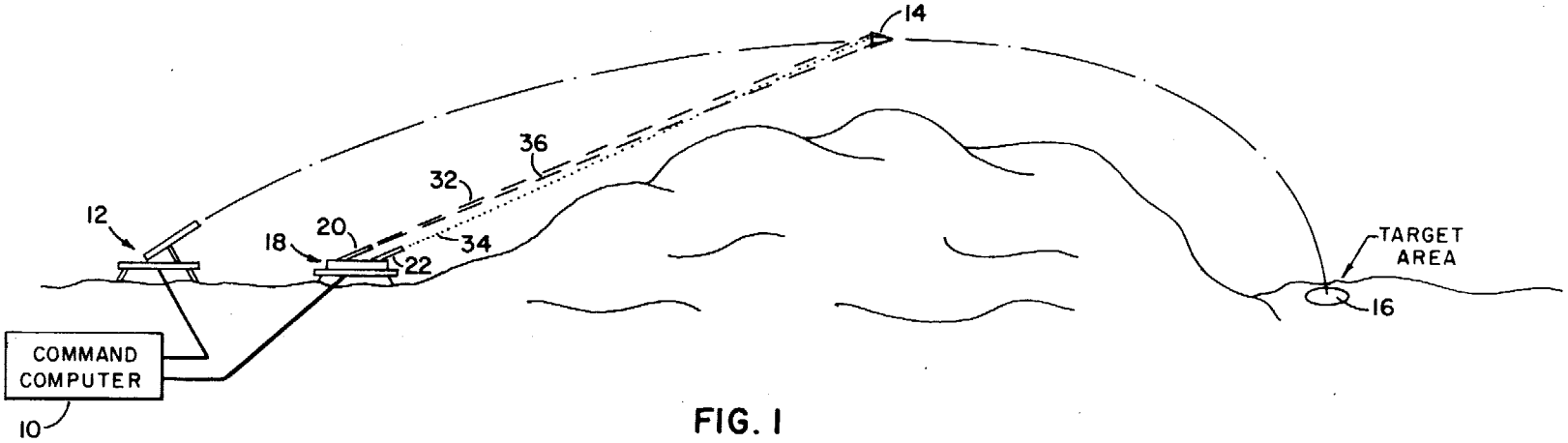
FIG. 1 is a pictorial view of a missile system according to this invention.

Referring now to FIG. 1, a system according to this invention is pictorially illustrated and includes a command computer 10 that is interconnected for controlling launcher 12 which launches missiles such as missile 14 in a predetermined trajectory to target area 16.

Figure 2:
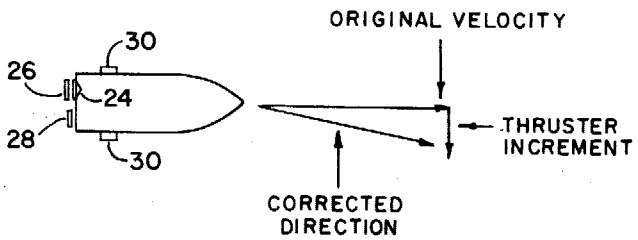
FIG. 2 schematically depicts the projectile being corrected by thrusters and directed in the newly computed trajectory.

Command computer 10 also controls laser missile tracker 18 which has laser transmitter means 20 and laser detector means 22. Missile 14 contains a corner reflector 24 (see FIG. 2) for receiving laser beam 32 and a polarizer 26 for returning the laser beam 34 as polarized light to laser detector 22. Missile 14 also has laser detector means 28 for receiving coded correction laser signals 36 from laser transmitter 20 to actuate appropriate side thrusters 30 and thereby correct the course of missile 14 on an appropriate trajectory to target 16.

Laser radiant energy transmitter 20 can be a Q-switch type laser allowing the use of pulse code modulation. For example, pulses could be transmitted 1000 times per second for normal tracking. The command to fire a thruster could be a group of three pulses separated by 200 microseconds. The laser transmitter may also contain two lasers, one for transmitting a particular different frequency to the reflector and another for transmitting a particular frequency to the receiver on the missile. Laser transmitter 20 transmits a beam that has a beam angle of approximately 0.5 milliradian. For example, a beam diameter of 10 centimeters at the laser transmitter would have a diameter of approximately 150 centimeters at a distance of 3000 meters from the laser transmitter.

Figure 3:
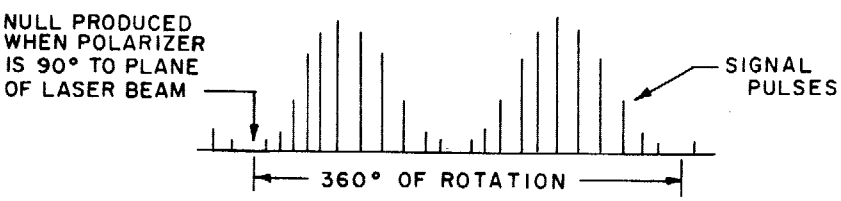
FIG. 3 illustrates the detected signal pulses from the polarizer on board the missile.

Corner reflector 24 is a conventional triangular cube type reflector for example that has a side of approximately 2 centimeters. This size gives an area of 1.73 square centimeters. Polarizer 26 causes the return signal from corner reflector 24 to be polarized and to be amplitude modulated due to rotation of missile 14. The form of amplitude modulated detector signal is shown in FIG. 3. By the amplitude modulation signal from the laser detector, by knowing the predetermined roll rate of the missile at launch and by knowing the predetermined position of the missile at launch, command computer 10 is able to determine the appropriate side thrusters 30 to be actuated and cause the missile to be corrected and directed into a trajectory that will lead from the missile to target 16.

Laser detector 22 utilizes a conventional P-I-N spot detector that has four quadrants separated by crosshair cruciform area. The laser reflections from missile 14 are detected by spot detector 22 and the processed signals therefrom are transmitted to command computer 10 to allow command computer 10 to reposition laser tracker 18 and maintain the laser beam on missile 14. Command computer 10 also computes a new trajectory from missile 14 to target 16 by comparing the newly established position of missile 14 relative to the predetermined trajectory that was initially programmed into command computer 10 to determine the error signals that must be transmitted to missile 14 through laser 20 to laser detector 28 to cause the appropriate side thrusters 30 to be actuated. The number of side thrusters 30 will depend upon the particular requirements and accuracy required of the missile in its application. Sequencing circuits in missile detector 28 switches from one pair of thrusters to the next automatically, but the time of firing is determined by ground command computer 10.

In this system, several corrections of the missile toward its target can be made. However, in adverse weather the final correction may occur about four seconds after launch. This correction of the missile reduces the launch errors considerably and makes the missile accuracy equivalent to the accuracy attainable with heavy artillery. Normally, atmospheric conditions will permit the laser radar to continue to track the missile to slant ranges of 25 kilometers. When this is the case and any new errors are detected (for example due to cross winds), additional commands are sent to the missile to further decrease impact errors.

Figure 4:
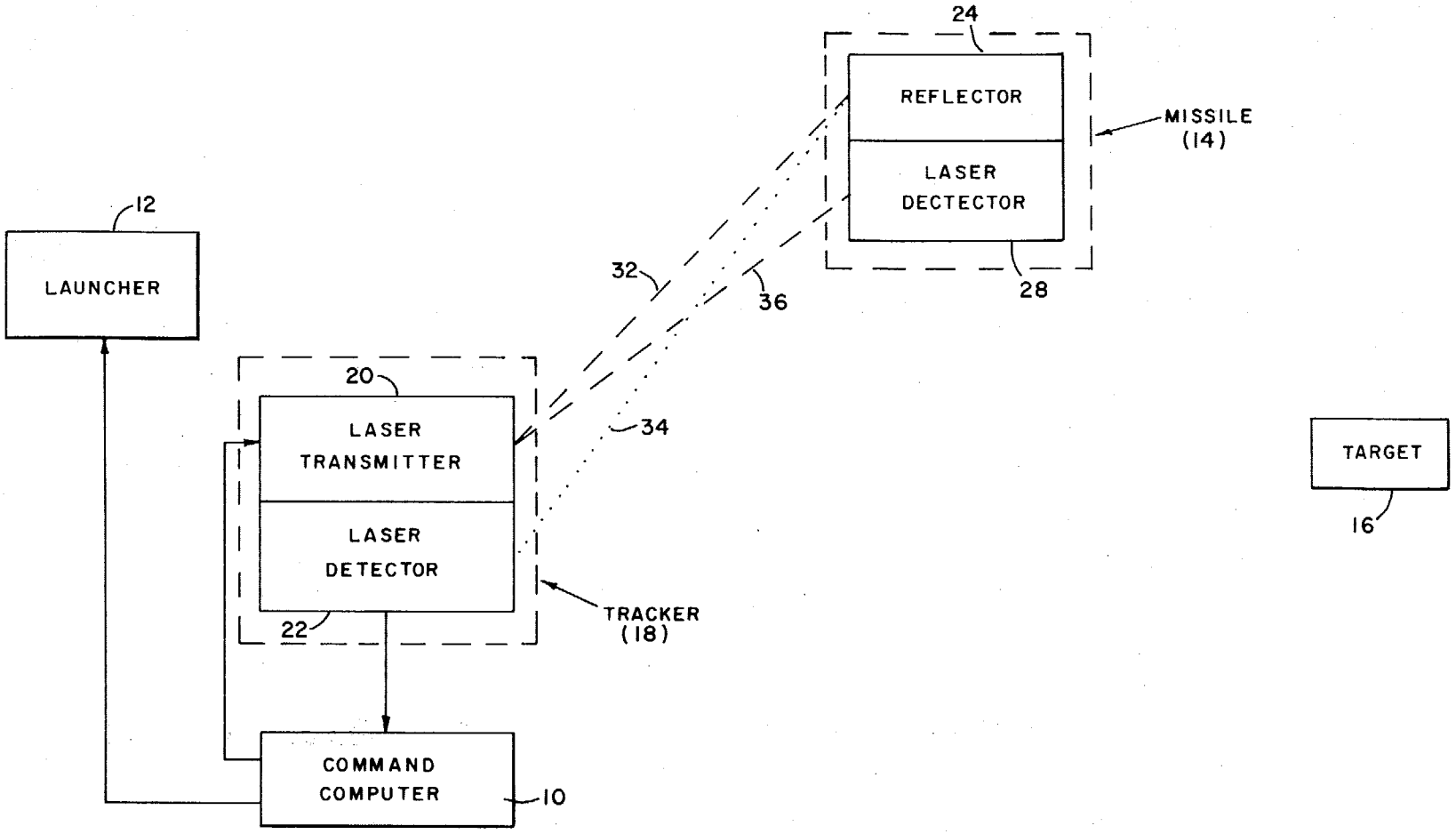
FIG. 4 illustrates a block diagram of the components of the system.

In operation, a target 16 is located by appropriate means and a trajectory from launcher 12 to target 16 is determined and programmed into command computer 10. Command computer 10 is then controlled to cause launcher 12 to launch missile 14 into the predetermined trajectory and laser tracker 18 tracks missile 14 by transmitting laser beam 32 (see FIG. 4) toward corner reflector 24 on board missile 14. The reflected signal is polarized by polarizer 26 and returned as beam 34 to laser detecter 22. Laser detector 22 receives the polarized light and produces an output in accordance with the present position of missile 14. The signals from laser detector 22 are transmitted to command computer 10 and compared with the predetermined trajectory that was initially programmed into command computer 10. Any errors in the present position of missile 14 are detected by command computer 10 and error signals accordingly are generated to cause signals from laser 20 to be transmitted as correction coded laser signals 36 to laser detector 28 and thereby cause appropriate side thrusters 30 to be actuated and cause missile 14 to be directed into a new trajectory relative to target 16. This procedure for correcting missile 14 is repeated as desired until missile 14 is out of range of laser tracker 18.

We claim:

1. A method for directing a missile to a predetermined target comprising launching a missile at a predetermined roll rate and in a predetermined trajectory from a launcher to a target so that the missile is rotating when launched at a predetermined roll rate; tracking the missile with a missile tracker by the steps of pulse code modulating a radiant energy beam, directing the modulated beam toward the missile in flight, intercepting the beam at the missile, reflecting the intercepted beam back toward the directed beam, amplitude modulating the reflected beam by subjecting the beam to polarization at a location substantially at the surface utilized for beam reflection, detecting the amplitude modulated reflected beam at the missile tracker and producing signals from the beam detected at the missile tracker; processing the signals to determine the relationship of the missile to the predetermined trajectory and producing error corrections from the processed signals in the form of a new trajectory from the missile to the target; transmitting the error corrections from the missile tracker toward the missile and detecting the transmitted error corrections at the missile; and utilizing the detected error corrections on the missile for directing the missile into the new trajectory.

2. A method for directing a missile to a predetermined target as set forth in claim 1, and further comprising the step of transmitting laser coded error signals as the error corrections.

3. A method for directing a missile to a predetermined target as set forth in claim 2, wherein the missile is directed to the new trajectory by subjecting the missile to control along a path toward the predetermined target, which includes the further step of applying lateral thrust forces to the missile at least one of a plurality of predetermined positions located around the periphery of the missile.

* * * * *